US011609532B2

(12) United States Patent
Suzuki

(10) Patent No.: US 11,609,532 B2
(45) Date of Patent: Mar. 21, 2023

(54) IMAGE FORMING APPARATUS INCLUDING RESTRICTING PORTION FOR RESTRICTING DISPLACEMENT OF DRAWER IN DIRECTION CROSSING MOVING DIRECTION OF DRAWER

(71) Applicant: BROTHER KOGYO KABUSHIKI KAISHA, Nagoya (JP)

(72) Inventor: Yasuhiro Suzuki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/711,094

(22) Filed: Apr. 1, 2022

(65) Prior Publication Data

US 2022/0317620 A1 Oct. 6, 2022

(30) Foreign Application Priority Data

Apr. 1, 2021 (JP) ..... JP2021-062937

(51) Int. Cl.
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1821* (2013.01); *G03G 2221/1869* (2013.01)

(58) Field of Classification Search
CPC ..... G03G 21/1647; G03G 21/1676; G03G 21/1821; G03G 21/1853; G03G 2221/1684; G03G 2221/1869
See application file for complete search history.

(56) References Cited

U.S. PATENT DOCUMENTS

2007/0160386 A1* 7/2007 Kawamura ..... G03G 21/1853 399/110
2020/0301345 A1 9/2020 Suzuki

FOREIGN PATENT DOCUMENTS

JP 2020-154204 A 9/2020

* cited by examiner

*Primary Examiner* — Sophia S Chen
(74) *Attorney, Agent, or Firm* — Merchant & Gould P.C.

(57) ABSTRACT

An image forming apparatus configured to form an image on a photosensitive drum includes: a main casing including a restricting portion; a drawer movable in a moving direction; a developing cartridge attachable to the drawer and including a developing roller; and a pressing member. The developing roller can contact and separate from the photosensitive drum. The pressing member causes the developing roller to separate from the photosensitive drum by pressing the developing cartridge attached to the drawer in a pressing direction crossing the moving direction. The restricting portion is configured to restrict displacement in the pressing direction of the drawer by abutting against the drawer. The drawer includes a first restricted portion, a second restricted portion, and a third restricted portion those are configured to be restricted by a first restricting portion, a second restricting portion, and a third restricting portion of the restricting portion, respectively.

18 Claims, 12 Drawing Sheets

IMAGE FORMING APPARATUS INCLUDING RESTRICTING PORTION FOR RESTRICTING DISPLACEMENT OF DRAWER IN DIRECTION CROSSING MOVING DIRECTION OF DRAWER

CROSS REFERENCE TO RELATED APPLICATIONS

This application claims priority from Japanese Patent Application No. 2021-062937 filed Apr. 1, 2021. The entire content of the priority application is incorporated herein by reference.

BACKGROUND

There has been known an image forming apparatus such as a laser printer including a drawer movable relative to a main casing, and a process cartridge attachable to and detachable form the drawer. In order to replace the process cartridge with a new process cartridge, the drawer is pulled frontward out of the main casing.

In one conventional image forming apparatus, a developing cartridge is pressed in an axial direction to move a developing roller away from a photosensitive drum. Further, in order to suppress displacement of the drawer in the axial direction due to a pressing force for separating the developing roller from the photosensitive drum, a restricted portion is provided at a front end portion and a rear end portion of the drawer to engage with a corresponding restricting portion of a main casing.

SUMMARY

With the conventional image forming apparatus, since the restricted portions are positioned to be spaced apart from each other in a front-rear direction, deformation of the drawer may occur at a portion between the two restricted portions when a pressing force is applied to the developing cartridge. The deformation of the drawer may result in distortion of an image, which is unfavorable.

In view of the foregoing, it is an object of the present disclosure to provide an image forming apparatus that can restrain deformation of a drawer caused by a pressing force for separating a developing roller from a photosensitive drum.

In order to attain the above and other objects, the present disclosure provides an image forming apparatus configured to form an image on a photosensitive drum. The image forming apparatus includes: a main casing; a drawer; a developing cartridge; and a pressing member. The main casing has a side surface formed with an opening. The drawer is movable in a moving direction through the opening between: an internal position in which the drawer is accommodated in the main casing; and an external position in which at least a portion of the drawer is exposed to an outside of the main casing. The developing cartridge is attachable to the drawer. The developing cartridge includes a developing roller that can contact and separate from the photosensitive drum. The pressing member causes the developing roller to separate from the photosensitive drum by pressing the developing cartridge attached to the drawer in a pressing direction crossing the moving direction. The main casing includes a restricting portion configured to restrict displacement in the pressing direction of the drawer by abutting against the drawer at the internal position. The restricting portion includes a first restricting portion, a second restricting portion, and a third restricting portion arranged in this order in a direction in which the drawer is moved from the external position toward the internal position. The drawer includes a first restricted portion restricted by the first restricting portion, a second restricted portion restricted by the second restricting portion, and a third restricted portion restricted by the third restricting portion.

With the above configuration, presence of the first to third restricted portions in the drawer can restrain deformation of the drawer due to a pressing force for separating the developing roller from the photosensitive drum. Particularly, deformation of a portion between the first restricted portion and the third restricted portion can be restrained by virtue of presence of the second restricted portion.

According to another aspect, the present disclosure also provides an image forming apparatus configured to form an image on a photosensitive drum. The image forming apparatus includes: a main casing; a drawer; a developing cartridge; a pressing member; and a frame. The main casing has a side surface formed with an opening. The drawer is movable in a moving direction through the opening between: an internal position in which the drawer is accommodated in the main casing; and an external position in which at least a portion of the drawer is exposed to an outside of the main casing. The developing cartridge is attachable to the drawer. The developing cartridge includes a developing roller that can contact and separate from the photosensitive drum. The pressing member causes the developing roller to separate from the photosensitive drum by pressing the developing cartridge attached to the drawer in a pressing direction crossing the moving direction. The frame extends in the moving direction and positioned adjacent to the drawer at the internal position. The frame comprises a first restricting portion, a second restricting portion, and a third restricting portion. The first restricting portion, the second restricting portion, and the third restricting portion are located at different positions in the moving direction. The first restricting portion, the second restricting portion, and the third restricting portion are configured to restrict displacement in the pressing direction of the drawer by abutting against the drawer.

With this configuration, since the first to third restricting portions of the frame abut against the drawer to restrict displacement in the pressing direction of the drawer, deformation of the drawer due to a pressing force for separating the developing roller from the photosensitive drum can be effectively restrained.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Hereinafter, an image forming apparatus 1 according to one embodiment of the present disclosure will be described with reference to FIGS. 1 through 11.

Figure 1:
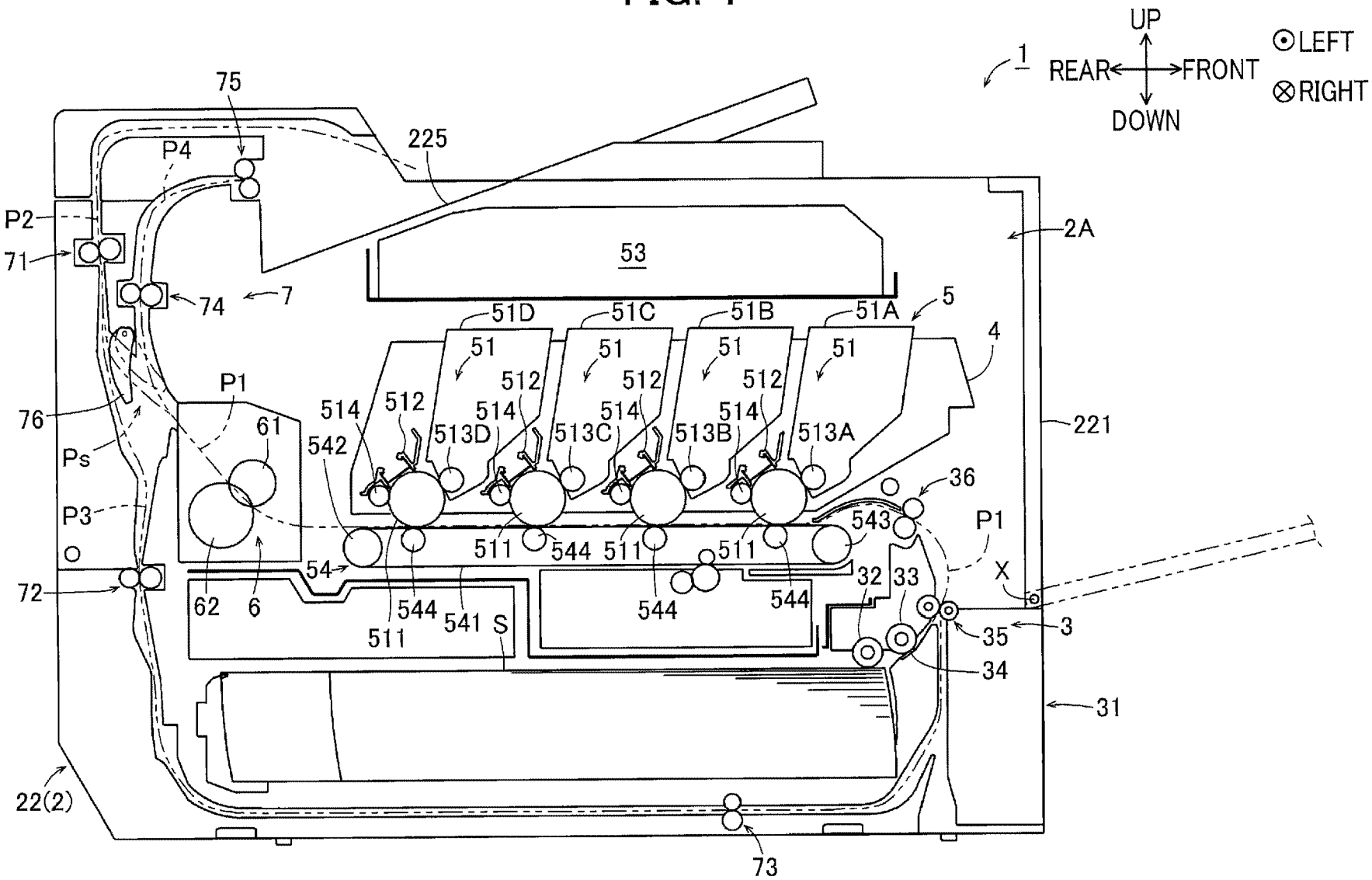
FIG. 1 is a central cross-sectional view of an image forming apparatus.
Figure 2:
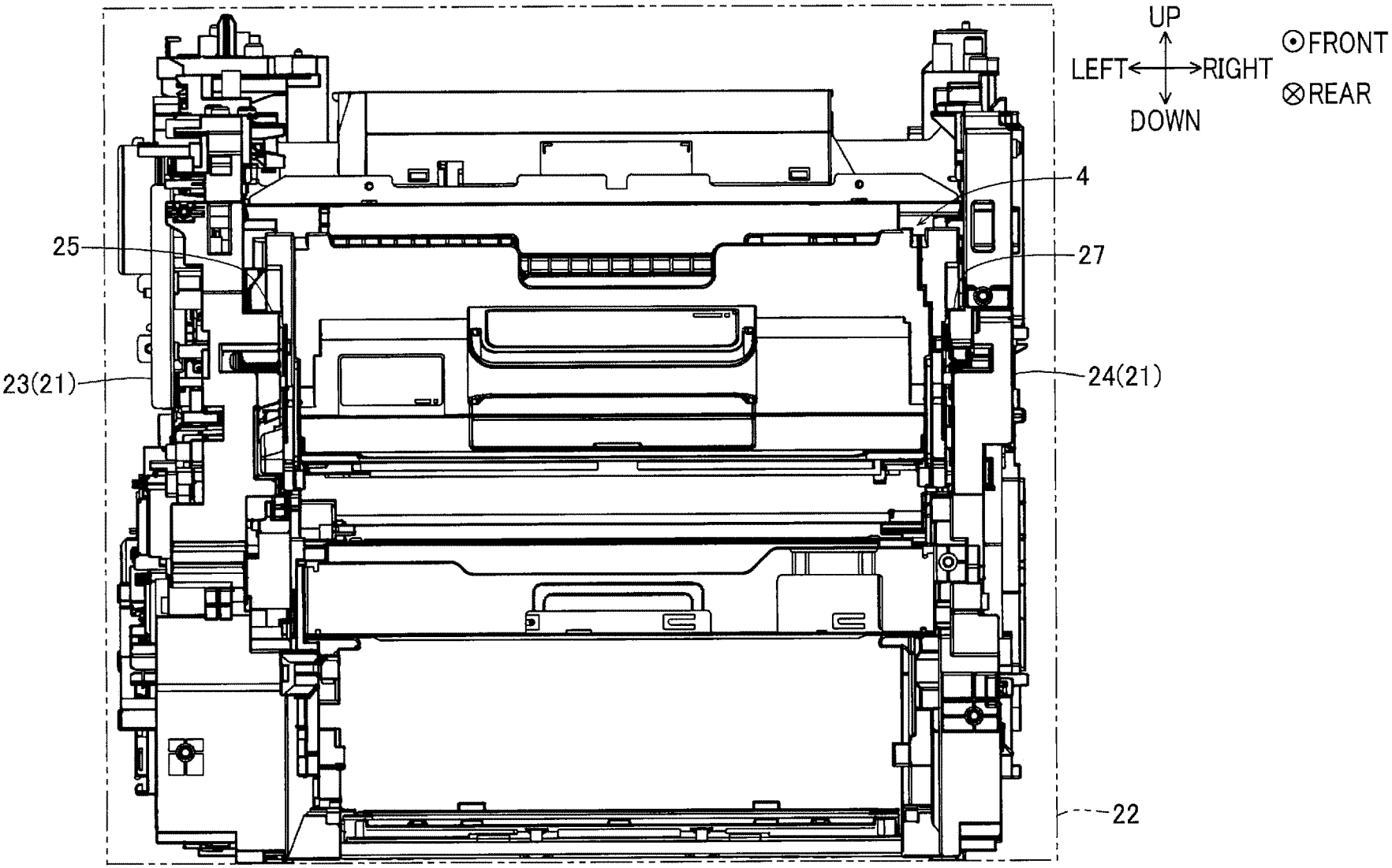
FIG. 2 is a front view of a frame and a drawer.

FIG. 1 is a central cross-sectional view of the image forming apparatus according to the embodiment. FIG. 2 is a front view illustrating a configuration of a frame 21 and a drawer 4.

The image forming apparatus 1 illustrated in FIG. 1 is an electro-photographic type color laser printer for forming an image of multiple colors on a sheet(s) S. However, the image forming apparatus 1 may be a monochromatic laser printer or an LED (light emitting diode) printer.

The terms "upward", "downward", "rightward", "leftward", "frontward", "rearward" and the like will be used throughout the description on the basis of FIG. 1. That is, a right side and a left side in FIG. 1 will be referred to as a front side and a rear side of the image forming apparatus 1, respectively. A near side and a far side in FIG. 1 will be referred to as a left side and a right side of the image forming apparatus 1, respectively. An upper side and a lower side in FIG. 1 will be referred to as an upper side and a lower side of the image forming apparatus 1, respectively.

Further, a leftward direction and a rightward direction will be collectively referred to as a "left-right direction", a frontward direction and a rearward direction will be collectively referred to as a "front-rear direction", and an upward direction and a downward direction will be collectively referred to as an "up-down direction".

The image forming apparatus 1 includes a main casing 2, a sheet feeding unit 3 configured to feed a sheet(s) S, an image forming unit 5 configured to form an image on the sheet S, a fixing unit 6 configured to fix the image to the sheet S, and a sheet conveying unit 7 configured to convey the sheet S on which the image has been formed by the image forming unit 5.

The main casing 2 is a box-like member having a rectangular parallelepiped shape, and accommodates therein the sheet feeding unit 3, the image forming unit 5, the fixing unit 6, and the sheet conveying unit 7. As illustrated in FIG. 2, the main casing 2 includes the frame 21 supporting components in the image forming apparatus 1, and a cover 22 surrounding the frame 21 and constituting an outer shell of the image forming apparatus 1.

The frame 21 includes a left frame 23, and a right frame 24. The left frame 23 is positioned at a left end portion inside the cover 22, and the right frame 24 is positioned at a right end portion inside the cover 22. The left frame 23 and the right frame 24 face each other in the left-right direction. Each of the left frame 23 and the right frame 24 extends in the front-rear direction and the up-down direction.

As illustrated in FIG. 1, the cover 22 has a front end portion formed with an opening 2A, and includes a front cover 221 configured to open and close the opening 2A. The front cover 221 has a lower end portion where a pivot axis X is positioned. The front cover 221 is pivotally movable about the pivot axis X between a closed position (a position indicated by a solid line in FIG. 1) where the front cover 221 closes the opening 2A, and an open position (a position indicated by a two-dotted chain line in FIG. 1) where the front cover 221 opens the opening 2A.

By pivotally moving the front cover 221 to open the opening 2A, the drawer 4 (described later) can be pulled out of the main casing 2 and can be attached to the main casing 2 through the opening 2A.

The cover 22 has an upper surface formed with a discharge tray 225 configured to support the sheet S on which the image has been formed. The discharge tray 225 has a recessed shape recessed to be inclined diagonally downward as extending in the rearward direction.

The sheet feeding unit 3 includes a sheet tray 31, a feeding roller 32, a separation roller 33, a separation pad 34, a pair of conveying rollers 35, and a pair of registration rollers 36. A conveying passage P1 extending from the sheet tray 31 and passing through the image forming unit 5 is formed inside the main casing 2.

The sheet tray 31 is disposed at a lower portion inside the main casing 2. The sheet tray 31 is configured to accommodate therein a stack of sheets S to be fed to the image forming unit 5. The sheet tray 31 is slidingly movable in the front-rear direction. Specifically, the sheet tray 31 is movable between an accommodated position (a position illustrated in FIG. 1) where the sheet tray 31 is accommodated in the main casing 2, and a pulled-out position where the sheet tray 31 is pulled frontward out of the main casing 2.

The sheets S accommodated in the sheet tray 31 are picked up and fed to the conveying passage P1 one by one using the feeding roller 32, the separation roller 33, and the separation pad 34. The sheet S fed to the conveying passage P1 is conveyed toward the image forming unit 5 using the pair of conveying rollers 35 and the pair of registration rollers 36.

The image forming unit 5 includes four drum units 51, the drawer 4, a scanner unit 53, and a transfer unit 54. The four drum units 51 are arranged in the front-rear direction at positions upward of the sheet feeding unit 3. The drum units 51 include developing cartridges 51A, 51B, 51C, and 51D provided corresponding to four colors of yellow, magenta, cyan, and black. The drum units 51 also include photosensitive drums 511, and chargers 512 in one-to-one correspondence. The developing cartridges 51A, 51B, 51C, and 51D include developing rollers 513A, 513B, 513C, and 513D, respectively, and drum cleaning rollers 514 in one-to-one correspondence.

The developing cartridges 51A to 51D serves as examples of a cartridge supported by the drawer 4. Any arbitrary member or component in the drum unit 51 can be employed as the cartridge.

The developing roller 513A is an example of a "first developing roller", the developing roller 513B is an example of a "second developing roller", the developing roller 513C is an example of a "third developing roller", and the developing roller 513D is an example of a "fourth developing roller".

The drawer 4 is configured to support the drum units 51 and is slidingly movable in the front-rear direction relative to the main casing 2. That is, the drawer 4 is movable through the opening 2A between an internal position (see FIG. 1) in which the drawer 4 is accommodated in the main casing 2 and an external position in which at least a portion of the drawer 4 is exposed to an outside of the main casing 2. The drawer 4 is configured to receive the developing cartridges 51A to 51D (the developing rollers 513A to 513D) such that the developing cartridges 51A to 51D are attachable to and detachable from the drawer 4 in the up-down direction.

The front-rear direction is an example of a "moving direction of a drawer". The rearward direction is an example of a "direction in which the drawer is moved from an exterior position toward an internal position". The rightward direction is an example of a "pressing direction crossing the moving direction of the drawer".

The photosensitive drums 511 are supported by the drawer 4 such that the photosensitive drums 511 are fixed in position relative to the drawer 4. Each of the developing cartridges 51A to 51D is supported by the drawer 4 so as to be movable relative to the corresponding one of the photosensitive drums 511 between a contacting position in which each of the developing roller 513A to 513D is in contact with the corresponding photosensitive drum 511, and a separated position in which the developing roller 513A to 513D is in separation from the corresponding photosensitive drum 511. To this effect, each of the developing cartridges 51A to 51D includes a pressed portion 515 (see FIG. 3).

Each of the pressed portions 515 has a rear end surface having a sloped surface. The sloped surface is configured to be pressed rightward by a corresponding one of pressing members 28 provided in the main casing 2 such as pins. As the pressed portion 515 is pressed by the corresponding pressing member 28, the pressed portion 515 is brought into sliding contact with a corresponding one of columnar portions of the drawer 4 to move the corresponding one of developing cartridges 51A to 51D frontward and rightward relative to the drawer 4. Accordingly, one of the developing rollers 513A to 513D corresponding to the pressed portion 515 is moved frontward and caused to separate from the corresponding photosensitive drum 511.

Four electrode springs 241 (see FIG. 5) are provided at the right frame 24 of the main casing 2 to urge the corresponding developing cartridges 51A to 51D leftward. Specifically, the electrode springs 241 are electrically connected to the corresponding developing cartridges 51A to 51D through terminals provided in the drawer 4 and urge the drawer 4 leftward.

The scanner unit 53 is disposed at an upper portion inside the main casing 2. In the scanner unit 53, laser beam based on image data is emitted through a polygon mirror, lenses, and a reflection mirror toward surfaces of the photosensitive drums 511 corresponding to the respective colors by way of high-speed scanning.

The transfer unit 54 includes a transfer belt 541, a driving roller 542, a driven roller 543, and transfer rollers 544. The transfer belt 541 is positioned below the photosensitive drums 511 and positioned on the opposite side of the conveying passage P1 from the photosensitive drums 511. The transfer belt 541 is looped over the driving roller 542 and the driven roller 543 positioned frontward of the driving roller 542. The transfer rollers 544 face the corresponding photosensitive drums 511 so that the transfer belt 541 is nipped between the transfer rollers 544 and the corresponding photosensitive drums 511.

In the image forming unit 5, the photosensitive drums 511 uniformly charged by the corresponding chargers 512 are selectively exposed to light by the scanner unit 53, whereby electric charge on the surfaces of the photosensitive drums 511 are selectively removed by the exposure to form electrostatic latent images on the surfaces of the photosensitive drums 511.

In the meantime, developing bias is applied to the developing rollers 513A to 513D. When the photosensitive drums 511 having the electrostatic latent images formed thereon face surfaces of the corresponding developing rollers 513A to 513D, toners carried on the developing rollers 513A to 513D are supplied to the electrostatic latent images on the photosensitive drums 511 because of electric potential differences between the electrostatic latent images and the developing rollers 513A to 513D. As a result, toner images are formed on the surfaces of the photosensitive drums 511. That is, the image forming apparatus 1 is configured to form images on the photosensitive drums 511.

When the sheet S fed toward the image forming unit 5 is carried onto the transfer belt 541, the sheet S is conveyed by the transfer belt 541 and is moved through a portion between the transfer belt 541 and the photosensitive drums 511. As the sheet S faces the toner images on the photosensitive drums 511, the toner images are transferred onto the sheet S because of transfer bias applied to the transfer rollers 544.

At this time, residual toner that has not been transferred to the sheet S may remain on the surfaces of the photosensitive drums 511. In accordance with rotation of the photosensitive drums 511, the residual toner is moved and electrically retained at surfaces of the corresponding drum cleaning rollers 514 due to drum cleaning bias applied to the drum cleaning rollers 514.

The fixing unit 6 is positioned downstream of the image forming unit 5 in a conveying direction of the sheet S. The fixing unit 6 includes a heat roller 61 configured to heat the sheet S, and a pressure roller 62 facing the heat roller 61. The heat roller 61 and the pressure roller 62 are in pressure contact with each other. The sheet S on which the toner images have been transferred by the image forming unit 5 is conveyed to the fixing unit 6. Then, the sheet S is moved through a portion between the heat roller 61 and the pressure roller 62, whereby the toner images are thermally fixed to the sheet S.

The sheet S to which the toner images have been thermally fixed is then conveyed to a downstream side of the fixing unit 6 by the sheet conveying unit 7. The sheet S conveyed by the sheet conveying unit 7 is discharged onto the discharge tray 225. Alternatively, the sheet S is again conveyed to the image forming unit 5 through a conveying passage P3 constituting a re-conveying passage (described later).

The sheet conveying unit 7 includes a conveying passage P2, the conveying passage P3, and a conveying passage P4. The conveying passage P2 branches from the conveying passage P1 at a branching position Ps and extends diagonally rearward and upward from the branching position Ps. The conveying passage P2 is a passage through which the sheet S that has been conveyed through the conveying passage P1 is conveyed.

The conveying passage P3 branches from the conveying passage P1 at the branching position Ps to extend downward therefrom. The conveying passage P3 is a passage through which the sheet S that has been conveyed through the conveying passage P2 is conveyed toward the conveying passage P1. The conveying passage P4 branches from the conveying passage P1 at the branching position Ps to extend upward therefrom. The conveying passage P4 is a passage through which the sheet S that has passed through the conveying passage P1 is conveyed.

The conveying passage P2 and the conveying passage P3 constitute the re-conveying passage for conveying the sheet S conveyed downstream through the image forming unit 5 again to the image forming unit 5. In the image forming apparatus 1, in order to perform duplex printing on the sheet S, for example, the sheet S subjected to printing by the image forming unit 5 and conveyed from the image forming unit 5 is again conveyed to the image forming unit 5 through the conveying passage P2 and the conveying passage P3.

The conveying passage P2 serves as a switch back conveying passage to alter a leading end and a trailing end of the sheet S conveyed from the image forming unit 5 for performing duplex printing.

A pair of switch back rollers 71 is provided at the conveying passage P2. The pair of switch back rollers 71 is configured to be driven to make both forward rotation and reverse rotation. Specifically, the forward rotation of the pair of switch back rollers 71 causes the sheet S to be introduced into the conveying passage P2, whereas the reverse rotation of the pair of switch back rollers 71 causes the sheet S to be conveyed from the conveying passage P2 to the conveying passage P3.

The conveying passage P3 extends from the branching position Ps so that the sheet S conveyed through the conveying passage P2 is conveyed toward the image forming unit 5. Specifically, the conveying passage P3 extends downward from the branching position Ps, and is bent frontward to extend horizontally, and is bent upward to merge the conveying passage P1. A portion of the conveying passage P3 that extends horizontally is positioned below the sheet tray 31 as illustrated in FIG. 1. However, the portion may be positioned above the sheet tray 31 instead.

A first pair of re-conveying rollers 72 and a second pair of re-conveying rollers 73 are provided at the conveying passage P3 to convey the sheet S passing through the conveying passage P3 toward the image forming unit 5. The first pair of re-conveying rollers 72 is positioned at a portion of the conveying passage P3 that extends downward. The second pair of re-conveying rollers 73 is positioned at the portion of the conveying passage P3 that extends horizontally.

The conveying passage P4 is a passage through which the sheet S conveyed through the conveying passage P1 is discharged onto the discharge tray 225. The conveying passage P4 also serves as a switch back conveying passage to alter a leading end and a trailing end of the sheet S conveyed from the image forming unit 5 for performing duplex printing. The conveying passage P4 extends upward from the branching position Ps and is bent frontward toward the discharge tray 225.

A first pair of discharge rollers 74 and a second pair of discharge rollers 75 are provided at the conveying passage P4. The second pair of discharge rollers 75 is positioned downstream of the first pair of discharge rollers 74 in the conveying direction of the sheet S. Both the first and second pair of discharge rollers 74 and 75 are configured to be driven to make forward rotation and reverse rotation.

The forward rotation of the first pair of discharge rollers 74 causes the sheet S to be introduced into the conveying passage P4, and the reverse rotation of the first pair of discharge rollers 74 causes the sheet S to be conveyed from the conveying passage P4 to the conveying passage P3. The forward rotation of the second pair of discharge rollers 75 causes the sheet S to be introduced into the conveying passage P4, and the reverse rotation of the second pair of discharge rollers 75 causes the sheet S to be conveyed from the conveying passage P4 to the conveying passage P3.

The sheet conveying unit 7 further includes a flapper 76 at the branching position Ps. The flapper 76 is pivotally movable about an axis positioned at an upper end portion of the flapper 76. Pivotal movement of the flapper 76 can switch a direction in which the sheet S that has passed through the conveying passage P1 is conveyed, i.e., whether the sheet S is to be conveyed toward the conveying passage P2 or toward the conveying passage P4.

That is, the flapper 76 is pivotally movable between a first position (indicated by a solid line in FIG. 1) and a second position (indicated by a two-dotted chain line in FIG. 1). When the flapper 76 is at the first position, the sheet S conveyed from the conveying passage P1 is guided into the conveying passage P4. When the flapper 76 is at the second position, the sheet S conveyed from the conveying passage P1 is guided into the conveying passage P2.

Next, the characteristic configuration in the image forming apparatus 1 will be described in detail with reference to FIGS. 3 through 11. According to the image forming apparatus 1, deformation of the drawer 4 can be suppressed due to a pressing force for separating the developing rollers 513A to 513D from the corresponding photosensitive drums 511. In order to exhibit the above advantages, the frame 21 includes a restricting portion 26, and the drawer 4 includes a restricted portion 47.

Figure 3:
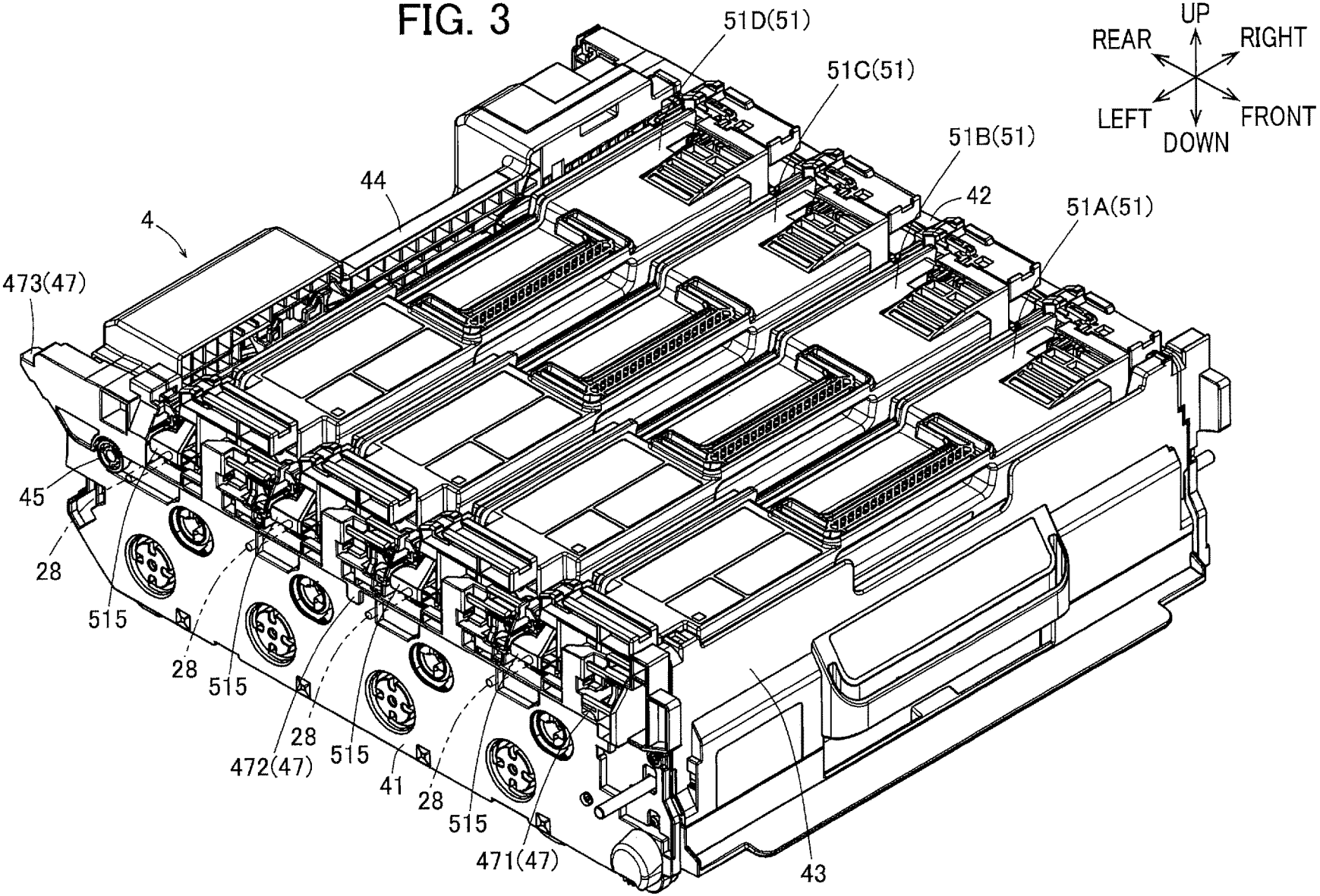
FIG. 3 is a perspective view of drum units and the drawer.
Figure 4:
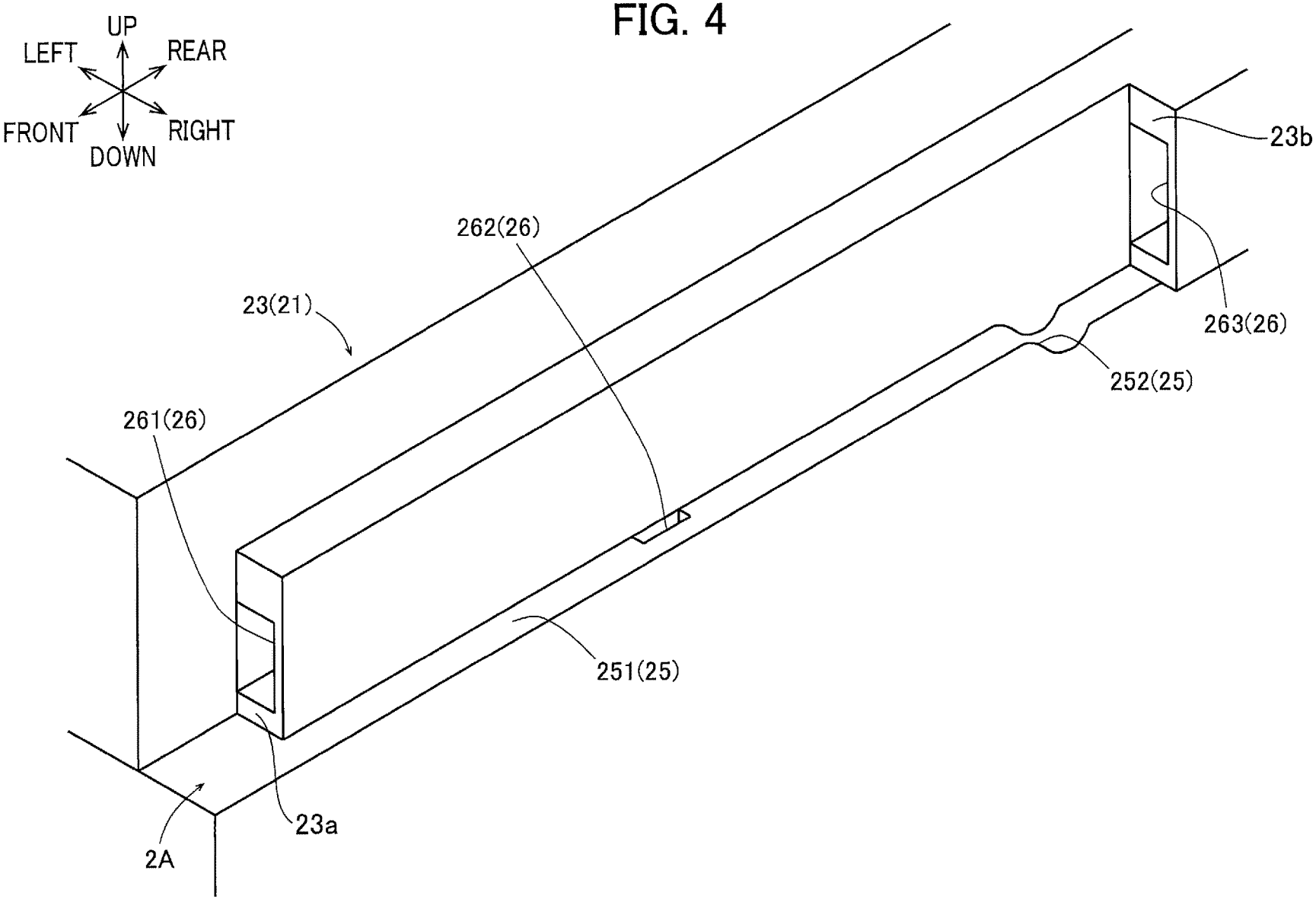
FIG. 4 is a perspective view of a left frame and particularly illustrating a portion in the vicinity of a restricting portion.
Figure 5:
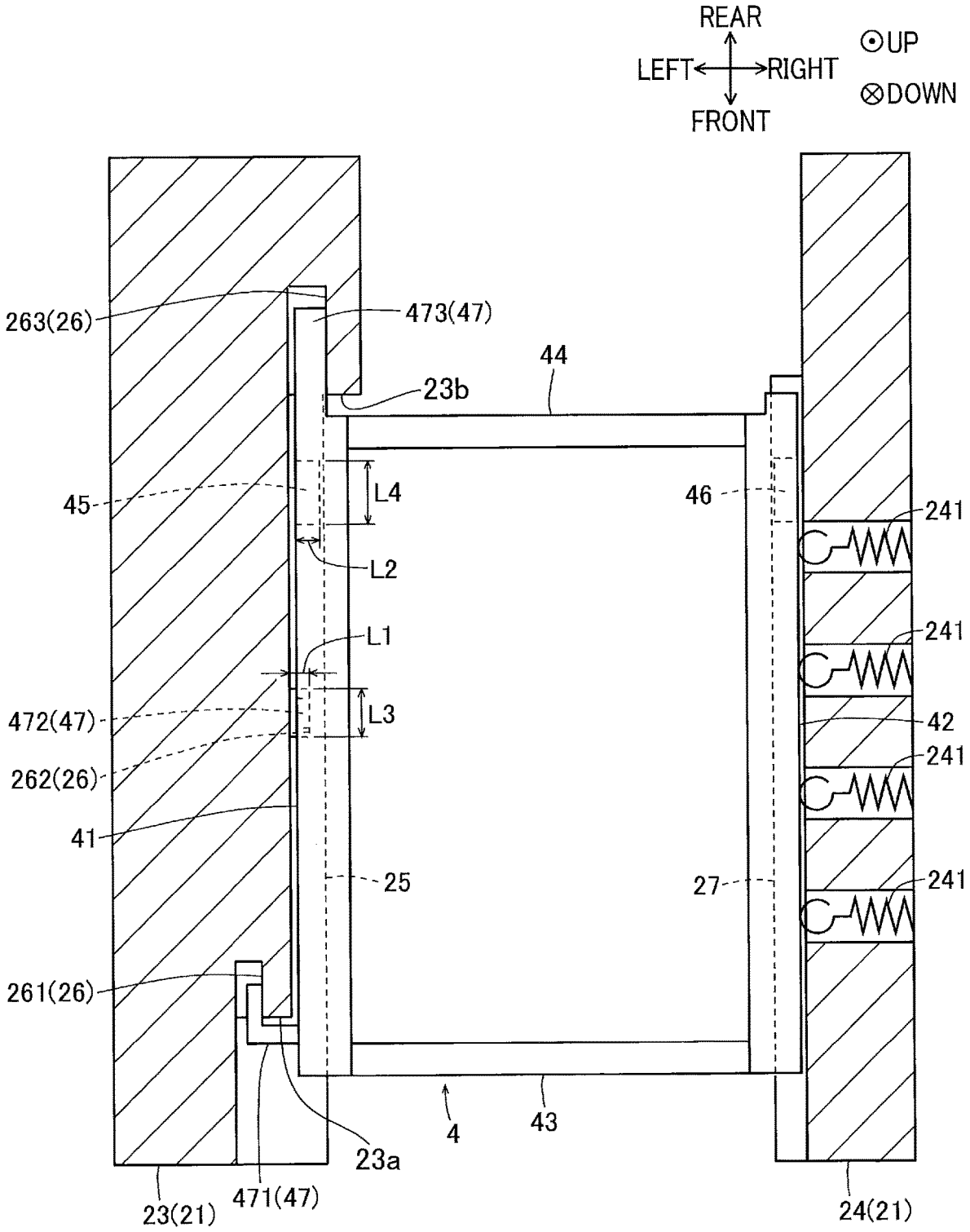
FIG. 5 is an explanatory view of a positional relationship between the restricting portion and a restricted portion.
Figure 6:
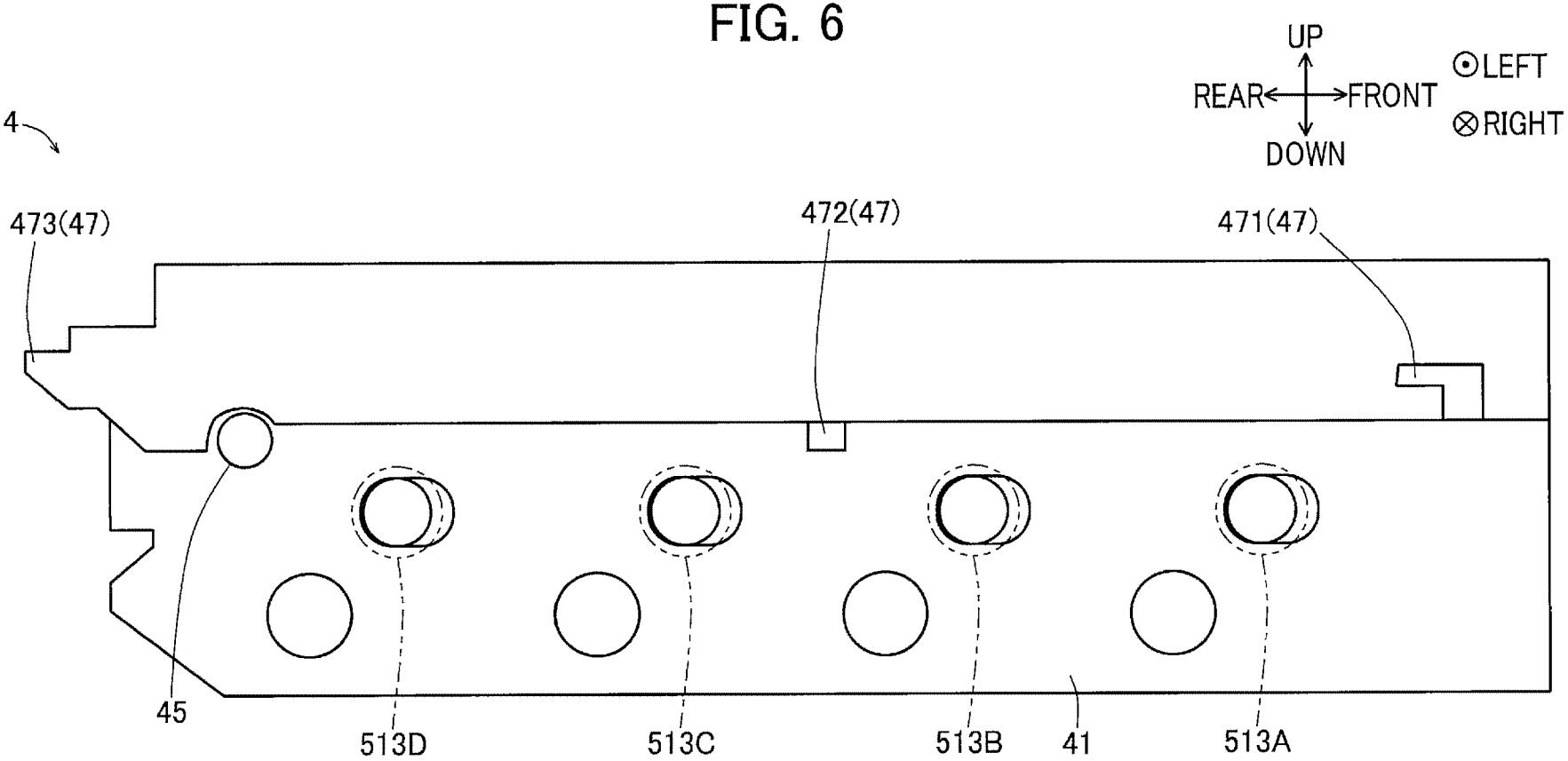
FIG. 6 is a left side view of the drawer.
Figure 7:
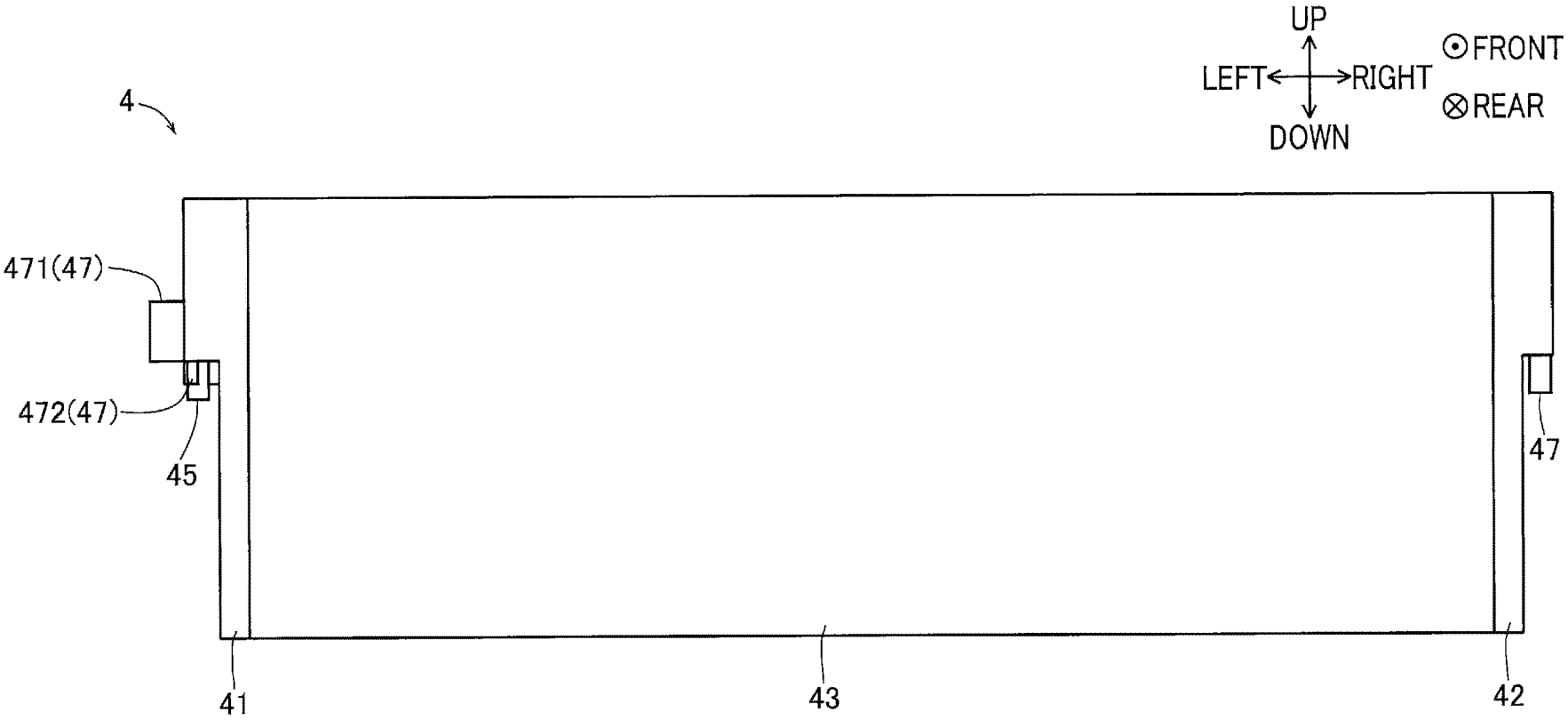
FIG. 7 is a front view of the drawer.
Figure 8:
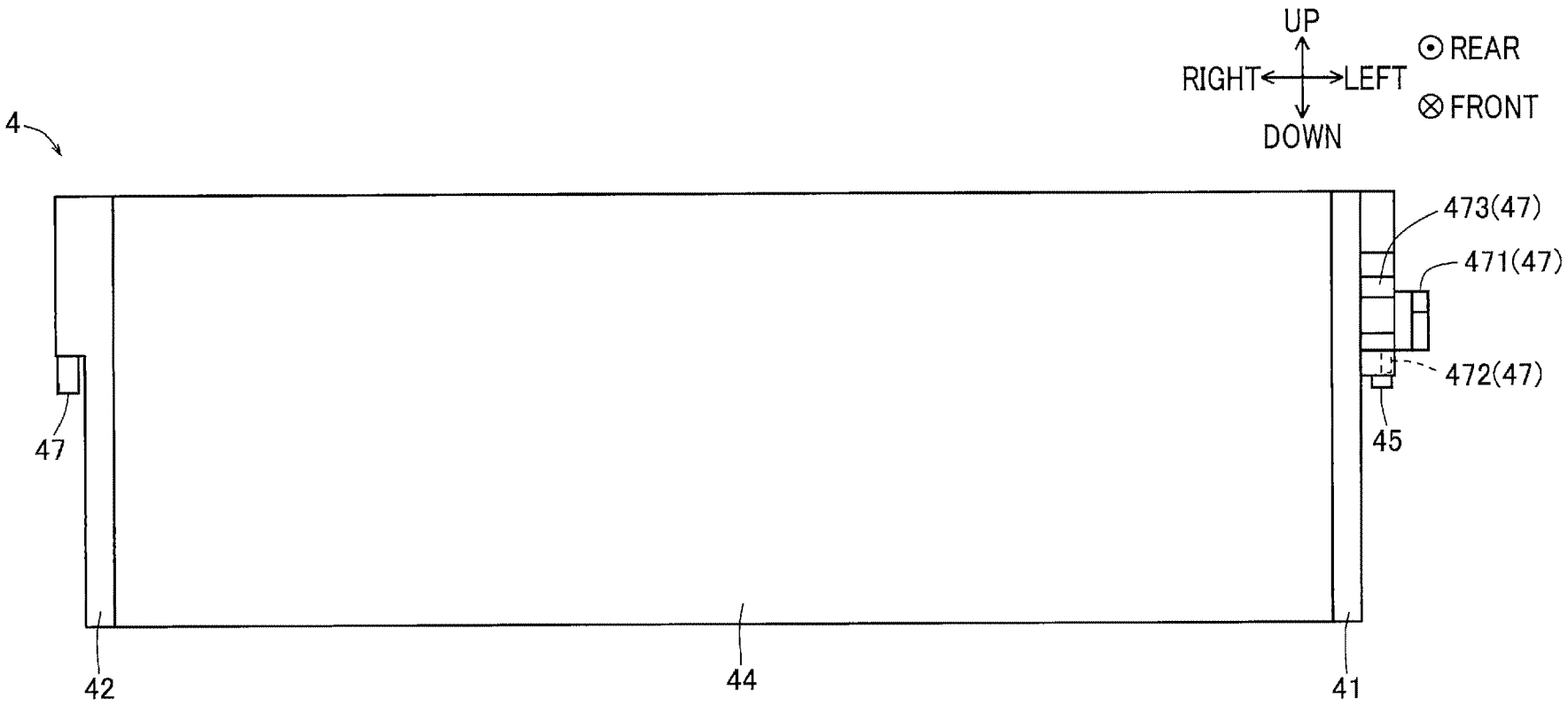
FIG. 8 is a rear view of the drawer.

FIG. 3 is a perspective view of the drum unit 51 and the drawer 4. FIG. 4 is a perspective view of the left frame 23 particularly illustrating a portion in the vicinity of the restricting portion 26. FIG. 5 is an explanatory view illustrating a positional relationship between the restricting portion 26 and the restricted portion 47. FIG. 6 is a left side view of the drawer 4. FIG. 7 is a front side view of the drawer 4. FIG. 8 is a rear view of the drawer 4.

Figure 9:
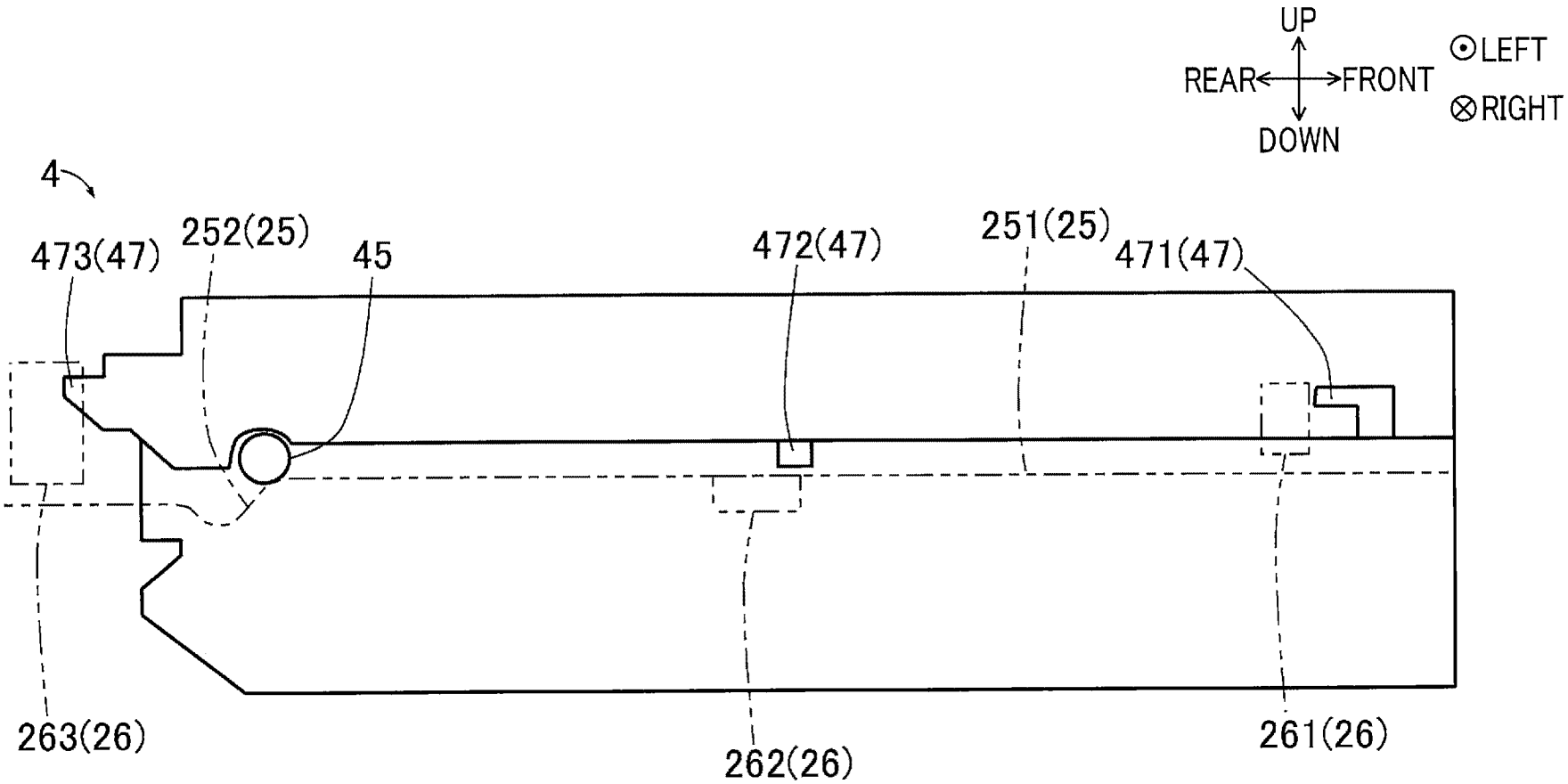
FIG. 9 is an explanatory view illustrating a state where a third restricted portion is brought into abutment against a third restricting portion in the middle of an attachment process of the drawer to a main casing.
Figure 10:
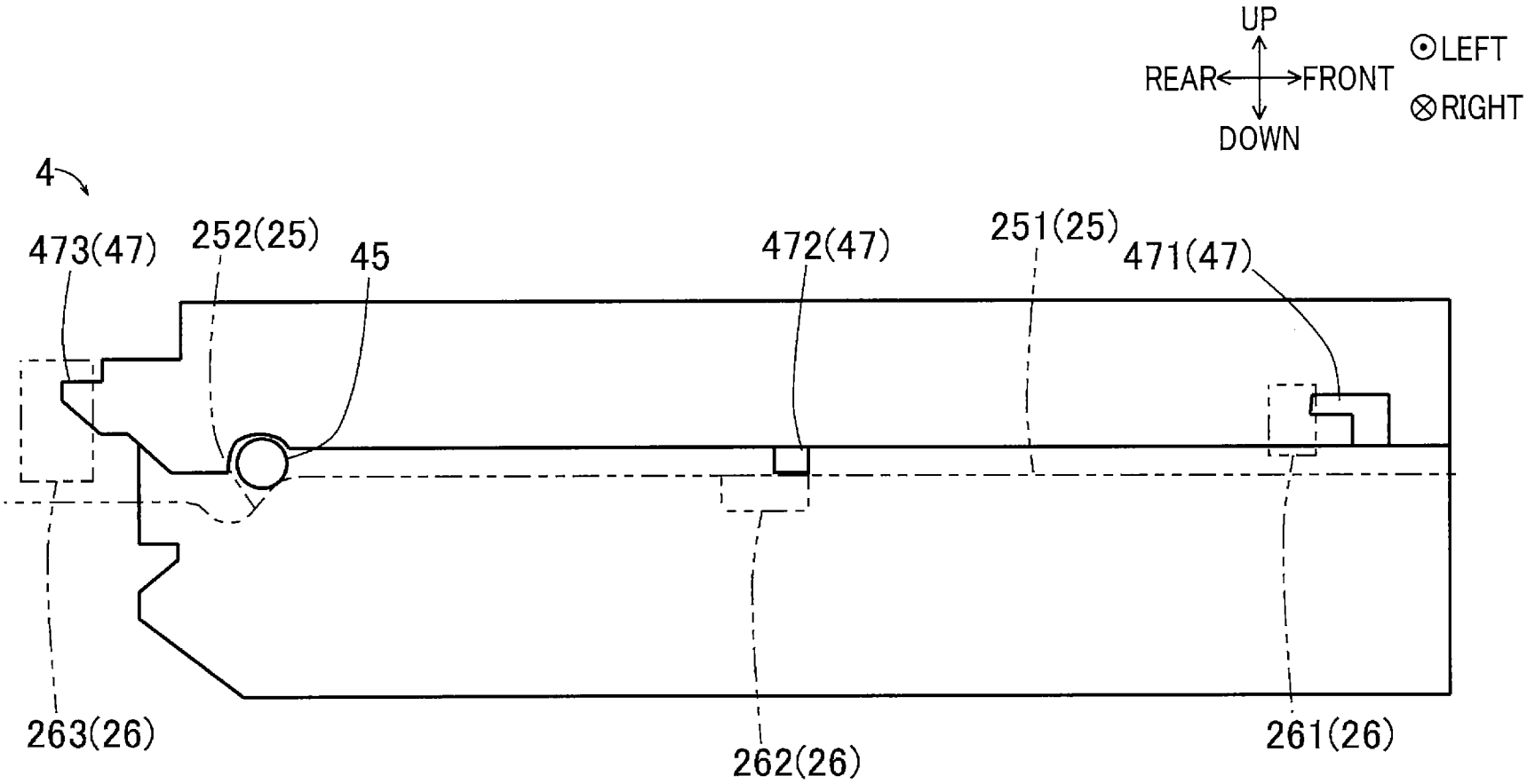
FIG. 10 is an explanatory view illustrating a state where a first restricted portion is brought into abutment against a first restricting portion in the middle of the attachment process of the drawer to the main casing.
Figure 11:
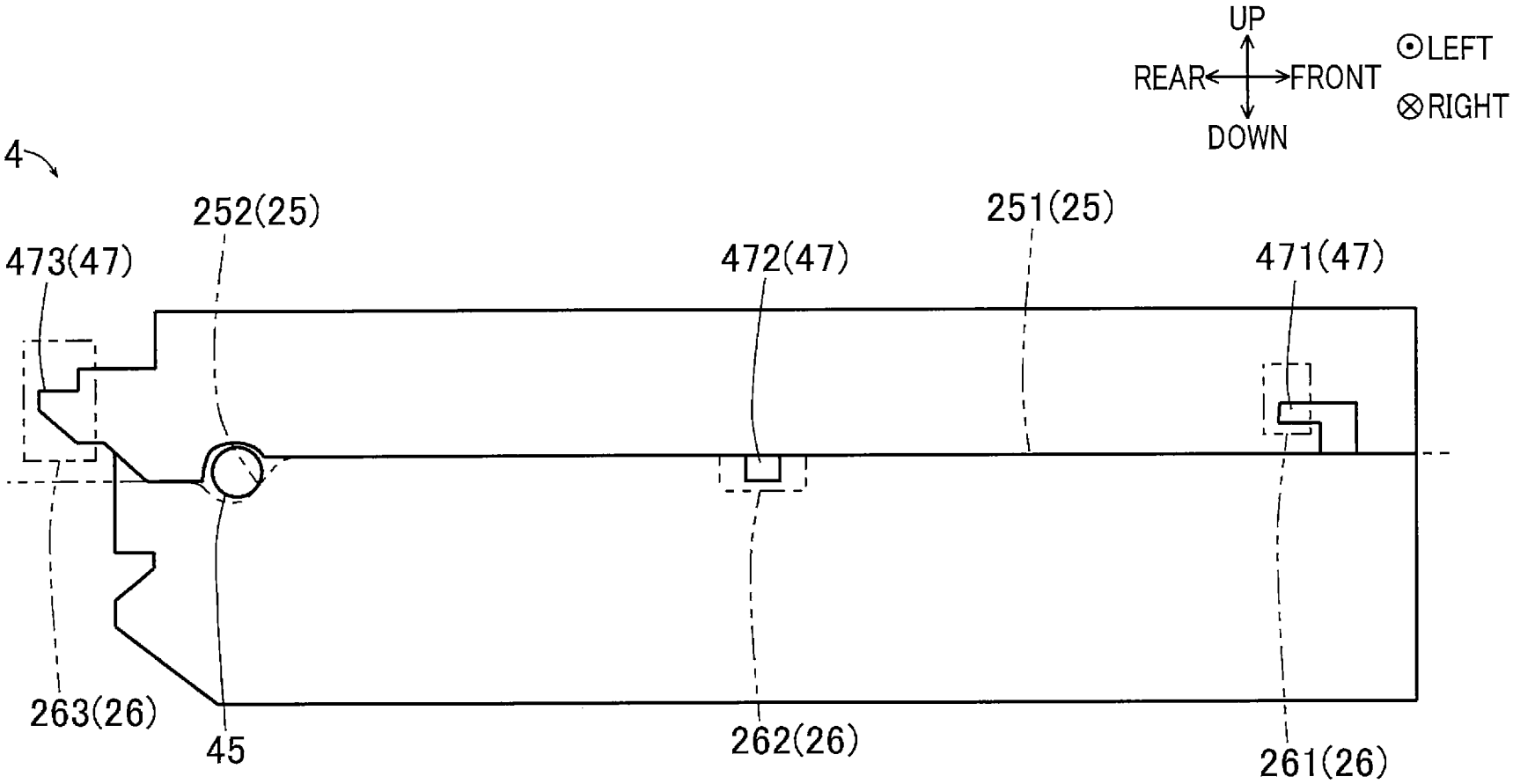
FIG. 11 is an explanatory view illustrating a state where the drawer is at an internal position.

FIG. 9 is an explanatory view illustrating a state where a third restricted portion 473 is brought into abutment against a third restricting portion 263 in the middle of attachment process of the drawer 4 to the main casing 2. FIG. 10 is a view illustrating a state where a first restricted portion 471 is brought into abutment against a first restricting portion 261 in the middle of the attachment process of the drawer 4 to the main casing 2. FIG. 11 is a view illustrating a state where the drawer 4 is at the internal position.

[Frame]

As illustrated in FIGS. 4 and 5, the left frame 23 includes a rail 25 and the restricting portion 26 at an inner surface thereof. Note that the right frame 24 includes a rail 27 at an inner surface thereof. The rail 27 is provided symmetrically with the rail 25 in the left-right direction. The left frame 23 is an example of a "frame".

The rail 25 extends in the front-rear direction which is the moving direction of the drawer 4, and is configured to guide movement of the drawer 4. The rail 25 includes a horizontal portion 251 extending horizontally rearward from the opening 2A, and a sloped portion 252 sloped diagonally rearward and downward from a rear end of the horizontal portion 251.

The sloped portion 252 is configured to guide a roller 45 (described later) of the drawer 4 downward during the attachment process of the drawer 4 to the main casing 2 to position the drawer 4 at the internal position. The sloped portion 252 is further configured to restrain frontward movement of the roller 45 due to vibration and the like to maintain the drawer 4 at the internal position.

The restricting portion 26 is configured abut against the restricted portion 47 of the drawer 4 when the drawer 4 is at the internal position to restrain displacement in the rightward direction of the drawer 4. The restricting portion 26 includes the first restricting portion 261, the second restricting portion 262, and the third restricting portion 263 those are arranged in this order in the rearward direction and the rightward direction.

The first restricting portion 261 is configured to abut against the first restricted portion 471 of the drawer 4 when the drawer 4 is at the internal position in order to suppress the displacement in the rightward direction of the drawer 4. The first restricting portion 261 is provided at a front end portion of the left frame 23 at a position further outward (i.e., leftward) of the rail 25 and upward of the rail 25. Specifically, the first restricting portion 261 is a recessed portion having an open end opening frontward at a surface 23*a* of the left frame 23. The surface 23*a* is a surface facing frontward and extending in the up-down direction and the left-right direction.

The second restricting portion 262 is configured to abut against the second restricted portion 472 of the drawer 4 when the drawer 4 is at the internal position to restrain the displacement in the rightward direction of the drawer 4. The second restricting portion 262 is positioned at an approximate center portion in the front-rear direction of the horizontal portion 251 of the rail 25. The second restricting portion 262 is a recessed portion having an open end opening upward at an upper surface of the horizontal portion 251.

Since the second restricting portion 262 is provided at the rail 25, a space for providing the second restricting portion 262 in the left-right direction can be reduced, thereby reducing a length in the left-right direction of the main casing 2. Further, since the second restricting portion 262 is in a form of recess, interference of the second restricting portion 262 with the drawer 4 guided along the rail 25 is hard to occur.

The third restricting portion 263 is configured to abut against the third restricted portion 473 of the drawer 4 when the drawer 4 is at the internal position to restrain the displacement in the rightward direction of the drawer 4. The third restricting portion 263 is disposed the left frame 23 at a position rearward of the rail 25 and upward of the rail 25. In other words, the third restricting portion 263 is positioned on the opposite side of the rail 25 from the opening 2A in the front-rear direction.

The left frame 23 has a surface 23*b* facing frontward, and extending in the up-down direction and the left-right direction at a rear end portion of the left frame 23. The third restricting portion 263 is a recessed portion having an open end opening frontward at the surface 23*b*.

Incidentally, the first restricting portion 261, the second restricting portion 262, and the third restricting portion 263 may not have a recessed shape, but may have any shape such as protruding shape as long as these restricting portions can restrain the displacement in the rightward direction of the drawer 4.

[Drawer]

As illustrated in FIGS. 3 and 5 through 8, the drawer 4 includes a left plate 41, a right plate 42, a front plate 43, a rear plate 44, the roller 45, a roller 46, and the restricted portion 47.

The left plate 41 constitutes a left end of the drawer 4, and extends in the front-rear direction. The left plate 41 is positioned adjacent to and faces the left frame 23 when the drawer 4 is at the internal position. The right plate 42 constitutes a right end of the drawer 4, and extends in the front-rear direction. The right plate 42 faces the right frame 24 when the drawer 4 is at the internal position.

The front plate 43 constitutes a front end of the drawer 4, and extends in the left-right direction. The rear plate 44 constitutes a rear end of the drawer 4, and extends in the left-right direction. The front plate 43 and the rear plate 44 connect the left plate 41 and the right plate 42 to each other. As such, the drawer 4 is in a form of a box-like shape.

The rollers 45 and 46 are configured to roll on the rails 25 and 27, respectively. The roller 45 is rotatably supported by an outer surface of the left plate 41, and the roller 46 is rotatably supported by an outer surface of the right plate 42. The drawer 4 can be moved smoothly in the front-rear direction by virtue of employment of the rollers 45 and 46. The rollers 45 and 46 are positioned between the second restricted portion 472 and the third restricted portion 473 in the front-rear direction.

The restricted portion 47 is configured to be restricted by the restricting portion 26 when the drawer 4 is at the internal position. As described above, the restricted portion 47 includes the first restricted portion 471 restricted by the first restricting portion 261, the second restricted portion 472 restricted by the second restricting portion 262, and the third restricted portion 473 restricted by the third restricting portion 263. That is, the first restricted portion 471, the second restricted portion 472, and the third restricted portion 473 are arranged in this order in the rearward direction and the rightward direction (i.e., as going inward in the drawer 4).

The first restricted portion 471 is configured to abut against the first restricting portion 261 when the drawer 4 is at the internal position such that displacement in the rightward direction of the first restricted portion 471 is restricted by the first restricting portion 261. The first restricted portion 471 is provided at a front end portion of the left plate 41.

The first restricted portion 471 is a protruding member having a substantially L-shape in a plan view. Specifically, the first restricted portion 471 has a base portion protruding leftward from the left plate 41, and a free end portion extending rearward from a tip end of the base portion (see FIG. 5). With this configuration, the free end portion of the first restricted portion 471 can enter the first restricting portion 261 from frontward in accordance with the movement in the rearward direction of the drawer 4.

The second restricted portion 472 is configured to abut against the second restricting portion 262 when the drawer 4 is at the internal position such that displacement in the rightward direction of the second restricted portion 472 is restricted by the second restricting portion 262. The second restricted portion 472 is a protruding member protruding downward from the left plate 41 and having a generally rectangular shape in a side view (see FIG. 6).

The second restricted portion 472 is positioned between the developing roller 513B and the developing roller 513C in the front-rear direction. Because the second restricted portion 472 is positioned at a generally center portion in the front-rear direction of the left plate 41 in this way, abutment of the second restricted portion 472 against the second restricting portion 262 can restrain rightward displacement of the center portion in the front-rear direction of the drawer 4 in a case where the pressed portions 515 are pressed rightward by the corresponding pressing members 28. As a result, rightward deformation of the center portion in the front-rear direction of the drawer 4 can be effectively restrained.

As illustrated in FIG. 6, the second restricted portion 472 has a lower end positioned upward of a lower end of the roller 45. With this configuration, interference of the second restricted portion 472 with the rail 25 does not occur when the roller 45 is in rolling contact with the rail 25. The second restricted portion 472 is inserted into the recessed second restricting portion 262 in accordance with movement in the downward direction of the drawer 4 caused by guiding of the roller 45 by the sloped portion 252.

The third restricted portion 473 is configured to abut against the third restricting portion 263 when the drawer 4 is at the internal position such that displacement in the rightward direction of the third restricted portion 473 is restricted by the third restricting portion 263. The third restricted portion 473 is a protruding member protruding rearward from an upper-rear end portion of the left plate 41. The third restricted portion 473 can enter the third restricting portion 263 from frontward in accordance with the movement in the rearward direction of the drawer 4.

Since the drawer 4 includes the first restricted portion 471, the second restricted portion 472, and the third restricted portion 473 those are configured to be restricted by the first restricting portion 261, the second restricting portion 262, and the third restricting portion 263, respectively, displacement and deformation of the drawer 4 can be restrained against a pressing force for separating the developing rollers 513A to 513D away from the corresponding photosensitive drums 511. Particularly, because of the presence of the second restricted portion 472, deformation of a portion of the drawer 4 between the first restricted portion 471 and the third restricted portion 473 can be suppressed, thereby avoiding distortion of an image printed on the sheet S.

[Operation for Attachment of Drawer to Main Casing]

When the drawer 4 is moved from the external position toward the internal position, the third restricted portion 473 is firstly brought into abutment against the third restricting portion 263 upon arrival of the roller 45 at the sloped portion 252 through the horizontal portion 251, as illustrated in FIG. 9.

As the drawer 4 is further moved toward the internal position, the first restricted portion 471 is secondly brought into abutment against the first restricting portion 261 as illustrated in FIG. 10. Then, as a result of further movement of the drawer 4 toward the internal position from the state illustrated in FIG. 9, the second restricted portion 472 is thirdly brought into abutment against the second restricting portion 262 as illustrated in FIG. 11, and hence, the drawer 4 reaches the internal position.

In this way, in accordance with the movement of the drawer 4 from the external position to the internal position, the third restricted portion 473 abuts firstly against the third restricting portion 263, then first restricted portion 471 abuts against the first restricting portion 261, and finally the second restricted portion 472 abuts against the second restricting portion 262.

That is, the first restricted portion 471 and the third restricted portion 473 those protrude along the moving direction of the drawer 4 abuts against the first restricting portion 261 and the third restricting portion 263, respectively, and subsequently the second restricted portion 472 protruding in a direction perpendicular to the moving direction of the drawer 4 abuts against the second restricting portion 262. This arrangement can achieve smooth abutment of the restricted portion 47 against the restricting portion 26.

[Relationship Between Second Restricting Portion and Roller]

As illustrated in FIG. 5, the second restricting portion 262 has a length L1 in the left-right direction smaller than a length L2 in the left-right direction of the roller 45. Further, the second restricting portion 262 has a length L3 in the front-rear direction smaller than a length L4 in the front-rear direction of the roller 45.

By virtue of this dimensional relationship between the second restricting portion 262 and the roller 45, the roller 45 can be prevented from entering the second restricting portion 262 during the movement in the front-rear direction of the drawer 4, thereby enabling the drawer 4 to be moved smoothly.

Incidentally, in order to avoid undesirable entry of the roller 45 into the second restricting portion 262, at least one of the dimensional relationships in the left-right direction and in the front-rear direction described above should be satisfied. For example, it is more preferable that the length L3 in the front-rear direction of the second restricting portion 262 is equal to or less than half the length L4 in the front-rear direction of the roller 45.

Figure 12:
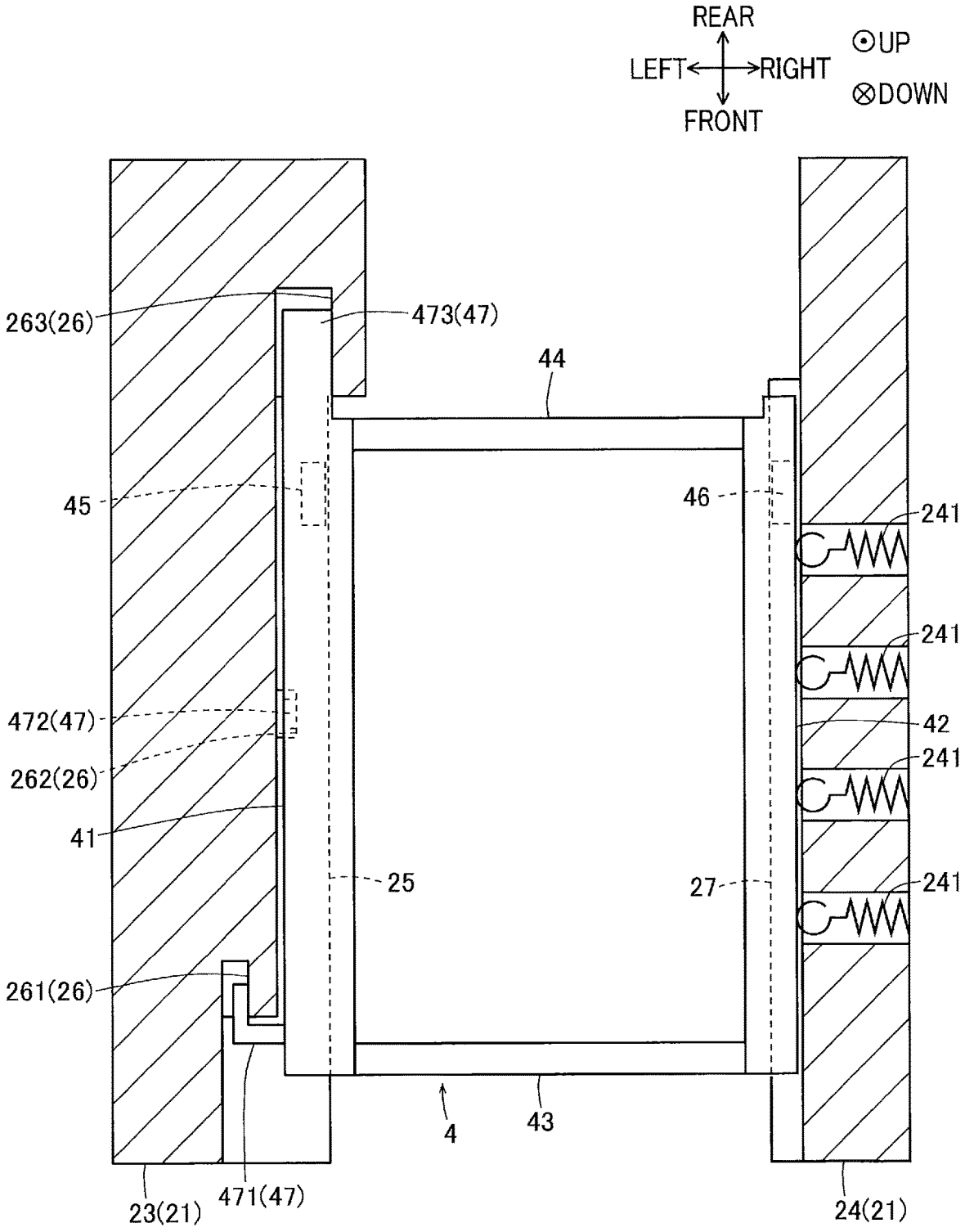
FIG. 12 is an explanatory view of a positional relationship between a second restricting portion and a second restricted portion.

Note that any arbitrary configuration can be employed as long as the roller 45 can be restrained from entering the second restricting portion 262. FIG. 12 is an explanatory view illustrating a positional relationship between a second restricting portion 262 and a second restricted portion 472 according to a modification. In this modification, the second restricting portion 262 and the roller 45 are positioned to be offset from each other in the left-right direction as illustrated in FIG. 12.

With this configuration, the roller 45 is not moved on the second restricting portion 262, but is moved beside the second restricting portion 262. Therefore, the roller 45 is hard to enter the second restricting portion 262 regardless of the dimensional relationship between the roller 45 and the second restricting portion 262.

Although three restricting portions 261 to 263, and three restricted portions 471 to 473 are provided in one-to-one correspondence in the above-described embodiment, four restricting portions and four restricted portions corresponding thereto may be employed.

For example, in addition to the above-described three restricting portions 261 to 263 and three restricted portions 471 to 473, an additional pair of restricting portion and restricted portion may be provided at a position between the developing roller 513A and the developing roller 513B, or between the developing roller 513C and the developing roller 513D. By providing the additional pair of restricting portion and restricted portion, displacement and deformation of the drawer 4 can further be restrained against a pressing force for separating the developing rollers 513A to 513D away from the corresponding photosensitive drums 511.

Further, in the above-described embodiment, the first to third restricting portions 261 to 263 are recessed portions formed at the rail 25 or a portion of the frame 23 other than the rail 25, and the first to third restricted portions 471 to 473 are protruding members. However, as a modification, the first to third restricting portions 261 to 263 may be protruding members, and the first to third restricted portions 471 to 473 may be recessed portions. Alternatively, a configuration other than combination of the recessed portions and the protruding members may be employed.

While the description has been made in detail with reference to the embodiment, it would be apparent to those skilled in the art that various changes and modifications may be made thereto.

What is claimed is:

1. An image forming apparatus configured to form an image on a photosensitive drum, the image forming apparatus comprising:

a main casing having a side surface formed with an opening;

a drawer movable in a moving direction through the opening between:

an internal position in which the drawer is accommodated in the main casing; and an external position in which at least a portion of the drawer is exposed to an outside of the main casing;

a developing cartridge attachable to the drawer, the developing cartridge comprising a developing roller that can contact and separate from the photosensitive drum; and a pressing member causing the developing roller to separate from the photosensitive drum by pressing the developing cartridge attached to the drawer in a pressing direction crossing the moving direction, wherein the main casing comprises a restricting portion configured to restrict displacement in the pressing direction of the drawer by abutting against the drawer at the internal position, wherein the restricting portion comprises a first restricting portion, a second restricting portion, and a third restricting portion arranged in this order in a direction in which the drawer is moved from the external position toward the internal position, and wherein the drawer comprises a first restricted portion restricted by the first restricting portion, a second restricted portion restricted by the second restricting portion, and a third restricted portion restricted by the third restricting portion.

2. The image forming apparatus according to claim 1, wherein the main casing comprises a frame extending in the moving direction and positioned adjacent to the drawer at the internal position, the frame comprising a rail extending in the moving direction and configured to guide movement of the drawer, wherein the first restricting portion and the third restricting portion are provided at a portion of the frame other than the rail, and wherein the second restricting portion is provided at the rail.

3. The image forming apparatus according to claim 2, wherein the second restricting portion is a recessed portion formed at the rail.

4. The image forming apparatus according to claim 3, wherein the drawer further comprises a roller positioned between the second restricted portion and the third restricted portion in the moving direction, the roller being configured to roll on the rail.

5. The image forming apparatus according to claim 4, wherein the rail comprises a sloped portion sloped downward as extending in the direction in which the drawer is moved from the external position toward the internal position, and wherein the second restricted portion has a lower end positioned upward of a lower end of the roller.

6. The image forming apparatus according to claim 4, wherein the second restricting portion has a length in the pressing direction smaller than a length in the pressing direction of the roller.

7. The image forming apparatus according to claim 4, wherein the second restricting portion has a length in the moving direction smaller than a length in the moving direction of the roller.

8. The image forming apparatus according to claim 4, wherein the second restricting portion and the roller are positioned to be offset from each other in the pressing direction.

9. The image forming apparatus according to claim 1, wherein the drawer is configured to receive a plurality of the developing rollers each belonging to a corresponding one of a plurality of the developing cartridges, wherein the plurality of the developing rollers comprises a first developing roller, a second developing roller, a third developing roller, and a fourth developing roller, wherein the first developing roller, the second developing roller, the third developing roller, and the fourth developing roller are arranged in this order in the direction in which the drawer is moved from the external position toward the internal position in a state where the plurality of the developing cartridges are attached to the drawer, and wherein the second restricting portion is positioned between the second developing roller and the third developing roller in the moving direction.

10. An image forming apparatus configured to form an image on a photosensitive drum, the image forming apparatus comprising:

a main casing having a side surface formed with an opening;

a drawer movable in a moving direction through the opening between:

an internal position in which the drawer is accommodated in the main casing; and an external position in which at least a portion of the drawer is exposed to an outside of the main casing;

a developing cartridge attachable to the drawer, the developing cartridge comprising a developing roller that can contact and separate from the photosensitive drum;

a pressing member causing the developing roller to separate from the photosensitive drum by pressing the developing cartridge attached to the drawer in a pressing direction crossing the moving direction; and a frame extending in the moving direction and positioned adjacent to the drawer at the internal position, wherein the frame comprises a first restricting portion, a second restricting portion, and a third restricting portion, the first restricting portion, the second restricting portion, and the third restricting portion being located at different positions in the moving direction, the first restricting portion, the second restricting portion, and the third restricting portion being configured to restrict displacement in the pressing direction of the drawer by abutting against the drawer.

11. The image forming apparatus according to claim 10, wherein the frame further comprises a rail extending in the moving direction and configured to guide movement of the drawer, wherein the first restricting portion and the third restricting portion are provided at a portion of the frame other than the rail, and wherein the second restricting portion is provided at the rail.

12. The image forming apparatus according to claim 11, wherein the second restricting portion is a recessed portion formed at the rail.

13. The image forming apparatus according to claim 12, wherein the drawer comprises a roller positioned between a restricted portion that is restricted by a second restricting portion and a restricted portion that is restricted by the third restricting portion in the moving direction, the roller being configured to roll on the rail.

14. The image forming apparatus according to claim 13, wherein the rail comprises a sloped portion sloped downward as extending in a direction in which the drawer is moved from the external position toward the internal position, and wherein the restricted portion that is restricted by the second restricting portion has a lower end positioned upward of a lower end of the roller.

15. The image forming apparatus according to claim 13, wherein the second restricting portion has a length in the pressing direction smaller than a length in the pressing direction of the roller.

16. The image forming apparatus according to claim 13, wherein the second restricting portion has a length in the moving direction smaller than a length in the moving direction of the roller.

17. The image forming apparatus according to claim 13, wherein the second restricting portion and the roller are positioned to be offset from each other in the pressing direction.

18. The image forming apparatus according to claim 10, wherein the drawer is configured to receive a plurality of the developing rollers each belonging to a corresponding one of a plurality of the developing cartridges, wherein the plurality of the developing rollers comprises a first developing roller, a second developing roller, a third developing roller, and a fourth developing roller, wherein the first developing roller, the second developing roller, the third developing roller, and the fourth developing roller are arranged in this order in the direction in which the drawer is moved from the external position toward the internal position in a state where the plurality of the developing cartridges are attached to the drawer, and wherein the second restricting portion is positioned between the second developing roller and the third developing roller in the moving direction.

* * * * *